US007479824B2

(12) United States Patent
Bushman et al.

(10) Patent No.: US 7,479,824 B2
(45) Date of Patent: Jan. 20, 2009

(54) DUAL MODE VOLTAGE SUPPLY CIRCUIT

(75) Inventors: Michael L. Bushman, Hanover Park, IL (US); James W. Caldwell, Saint Charles, IL (US); Neal W. Hollenbeck, Palatine, IL (US)

(73) Assignee: Freescale Semiconductor, Inc., Austin, TX (US)

( * ) Notice: Subject to any disclaimer, the term of this patent is extended or adjusted under 35 U.S.C. 154(b) by 90 days.

(21) Appl. No.: 11/457,312

(22) Filed: Jul. 13, 2006

(65) Prior Publication Data

US 2008/0012628 A1 Jan. 17, 2008

(51) Int. Cl.
*G05F 1/46* (2006.01)
*G05F 3/08* (2006.01)

(52) U.S. Cl. ..... 327/545; 327/101; 327/540

(58) Field of Classification Search ..... None
See application file for complete search history.

(56) References Cited

U.S. PATENT DOCUMENTS 6,150,860 A * 11/2000 Chun ..... 327/198
7,053,696 B2 * 5/2006 Shiratake et al. ..... 327/543
2005/0024127 A1 * 2/2005 Kihara ..... 327/540
2006/0267673 A1 * 11/2006 Gan et al. ..... 327/540

* cited by examiner

*Primary Examiner*—Lincoln Donovan
*Assistant Examiner*—Terry L Englund
(74) *Attorney, Agent, or Firm*—Vedder Price P.C.

(57) ABSTRACT

A dual mode voltage supply circuit (50) includes an active mode voltage supply circuit (58) and a passive mode voltage supply circuit (60). The active mode voltage supply circuit (58) is selectively operative to supply a voltage (57) based on mode control information (22). The active mode voltage supply circuit (58) is operative to provide a first current capacity. The passive mode voltage supply circuit (60) is operatively coupled to the active mode voltage supply circuit (58). The passive mode voltage supply circuit (60) is operative to supply the voltage (57) when the active mode voltage supply circuit (58) is not supplying the voltage (57). The passive mode voltage supply circuit (60) is operative to provide a second current capacity that is less than the first current capacity.

15 Claims, 5 Drawing Sheets

DUAL MODE VOLTAGE SUPPLY CIRCUIT

FIELD OF THE INVENTION

The present disclosure relates generally to power supply circuits, and more particularly to power supply circuits that provide different levels of current capacity.

BACKGROUND OF THE INVENTION

A radio frequency (RF) modulator is a device that receives a baseband signal and generates a modulated signal based thereon. For example, an RF modulator may be used to receive a video and/or audio signal from an input source such as a DVD player, VCR, Camcorder, digital audio players, a media player, or other suitable video and/or audio signal source and generate a modulated signal that can be fed to a video and/or audio output device such as an analog television or other suitable device. Some input devices include an RF modulator allowing the output of the device to be fed directly into a television. However, newer input video devices do not typically include an RF modulator. These newer devices typically generate composite, component, S-Video, or other format for signals that are fed directly into newer televisions that include an input capable of receiving these signals.

In order to use a newer input device with a legacy output device that does not include inputs for composite, component, S-Video, or other format, an RF modulator may be operatively coupled within or between the newer input device and the legacy output device. When the output device, such as an analog television, needs to receive a frequency modulated (FM) signal, the RF modulator typically includes at least one variable oscillator capable of modulating the output signal in various frequency bands or channels. These variable oscillators are typically voltage controlled and are often referred to as voltage controlled oscillators (VCOs).

A tuner typically communicates with the VCO to adjust the oscillations to a predetermined frequency. The tuner may include level shifting circuits that provide control signals to varactors that are part of the VCO. When adjusting the oscillations of the VCO by controlling the varactors, such as when tuning from one television channel to another, the level shifting circuits in the tuner require more power and thus more current than when the tuner is fixed on a channel. However, when supplying a higher current to the level shifting circuits, noise may be induced in the RF modulator. The noise may adversely interfere with the modulated signal and consequently reduce the quality of the video and/or audio output.

In one method, an integrated circuit (IC) that includes a single mode passive voltage supply is used to supply power to the tuner. The IC typically includes an internal voltage divider circuit that is operatively coupled to a large external (e.g., off chip) capacitor via pins. The external capacitor is used to supply the additional current needed when the tuner is adjusting the oscillations of the VCO. Although this method works, it requires a large external capacitor coupled to the IC and additional pin count, which increases the size and cost of the voltage supply.

What is desired is an improved voltage supply circuit.

BRIEF DESCRIPTION OF THE DRAWINGS

The invention will be more readily understood in view of the following description when accompanied by the below figures and wherein like reference numerals represent like elements.

DETAILED DESCRIPTION OF A PREFERRED EMBODIMENT

Figure 1:
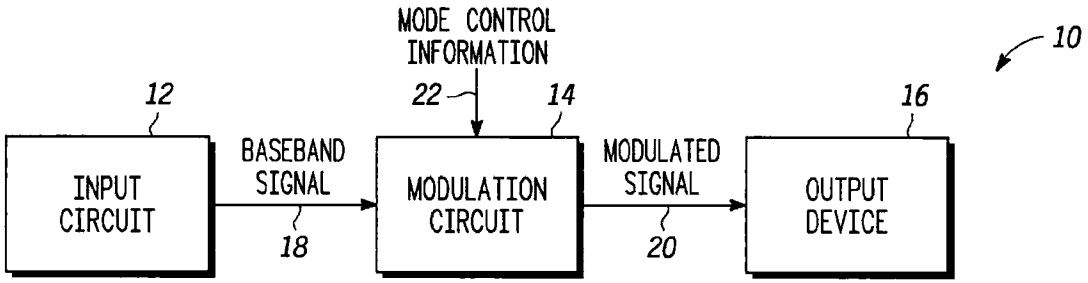
FIG. 1 is a functional block diagram of an exemplary modulation system.

In one embodiment, a dual mode voltage supply circuit includes a switchable active mode voltage supply circuit and a passive mode voltage supply circuit. The active mode voltage supply circuit is selectively operative to supply a voltage based on mode control information, such as an indication (e.g., one or more bits or other suitable information) that a tuner should be tuned to a different frequency. The active mode voltage supply circuit is operative to provide a first current capacity. The passive mode voltage supply circuit is operatively coupled to the active mode voltage supply circuit. The passive mode voltage supply circuit is operative to supply the voltage when the active mode voltage supply circuit is not supplying the voltage. The passive mode voltage supply circuit is operative to provide a second current capacity that is less than the first current capacity. In one example, a dual mode voltage supply operates in an active and passive mode and is selectively switched to provide an increased current capacity to a tuner when required. The dual mode voltage supply circuit is also capable of minimizing noise interference by employing a passive current capacity when the tuner does not require increased capacity. In addition, the dual mode voltage supply circuit does not require any external capacitive elements and therefore may be implemented in a signal integrated circuit or included in an integrated circuit with additional modulation components or other circuits.

In one example, the active mode voltage supply circuit includes a switch operative to enable the active mode voltage supply circuit to supply the voltage in response to the mode control information.

In one example, the active mode voltage supply circuit includes a voltage divider circuit operatively coupled to an amplifier circuit that provides the first current capacity. The amplifier may include a differential amplifier having an input operatively coupled to the voltage divider circuit. Alternatively, the amplifier may include a unity gain operational amplifier having an input operatively coupled to the voltage divider circuit.

In one example, the passive mode voltage supply circuit includes a voltage divider operatively coupled to at least one on chip capacitor. The dual mode voltage supply circuit may include a charge circuit operative to charge the at least one on chip capacitor when the passive mode voltage supply circuit is supplying the voltage. The charge circuit includes a switch operatively coupled to at least one resistive element, such as a resistor or other element(s) that provides a suitable resistance.

In one example, the dual mode voltage supply circuit includes a voltage supply circuit operatively coupled to the active and passive mode voltage supply circuits. The voltage supply circuit is operative to provide a second voltage independent of the mode control information. The second voltage is less than the voltage. The voltage supply circuit includes at least one capacitive element, such as an on-chip capacitor or other suitable element(s) that provide a suitable capacitance, operatively coupled to a transistor.

In one example, an integrated circuit includes a voltage controlled oscillator (VCO), a tuner, and the dual mode voltage supply circuit. The tuner communicates with the VCO and is operable to adjust oscillations of the VCO to a predetermined frequency. The dual mode voltage supply circuit is operative to supply the voltage to the tuner. The second voltage is supplied to the VCO.

In one example, the active mode voltage supply circuit supplies the voltage when the tuner is adjusting the oscillations. The passive mode voltage supply circuit supplies the voltage when the VCO is oscillating at the predetermined frequency. The tuner generates the mode control information based on the oscillations and the predetermined frequency.

In one example, a modulation system includes an input video and/or audio source circuit, a modulation circuit, and an output device. The input circuit is operative to generate a baseband signal. The modulation circuit includes the VCO, the tuner, and the dual mode voltage supply circuit. The tuner communicates with the VCO and the dual mode voltage supply circuit is operative to supply the voltage to the tuner. The modulation circuit is operative to receive the baseband signal and generate a modulated signal based thereon. The output device is operative to receive the modulated signal and generate at least one of a video and/or audio output based thereon.

As used herein, the term circuit and/or device can include an electronic circuit, a processor (shared, dedicated, or group) and memory that execute one or more software or firmware programs, a combinational logic circuit, ASIC, and/or other suitable components that provide the described functionality.

Referring now to FIG. 1, a functional block diagram of an exemplary modulation system 10 is depicted. The modulation system 10 may include an input circuit 12, a modulation circuit 14, and an output device 16. The input circuit 12 may be operative to generate a baseband signal 18. Exemplary input circuits 12 include, but are not limited to, digital video decoder circuits, a digital video disk (DVD) player, a camcorder, a video gaming system, a videocassette recorder (VCR), a media player, or any suitable structure that generates a baseband audio and/or video signal. For example, if the input circuit 12 is in a DVD player, the DVD player may be operative to read audio and/or video information from a DVD and generate a baseband signal based thereon.

The modulation circuit 14 may be operative to receive the baseband signal 18 and generate a modulated signal 20 based thereon. The modulated signal 20 is of a type that is compatible with the output device 16, such as an analog TV or TV receiver. For example, if the output device is capable of receiving a frequency modulated (FM) signal, the modulation circuit 14 may receive the baseband signal 18 and generate a FM modulated signal. The modulation circuit 14 may be operative to receive mode control information 22 and operate to provide passive or active voltage (or current) supply modes based thereon. For example, the modulation circuit 14 may operate in one mode when adjusting a frequency band of an FM modulated signal and in another mode when the frequency band is not being adjusted.

The output device 16 may be operative to receive the modulated signal 20 and generate an audio and/or video output based thereon. The output device 16 may be any suitable device capable of generating an audio and/or video output. Exemplary output devices 16 include, but are not limited to, a television, a radio, or any other suitable device.

Figure 2:
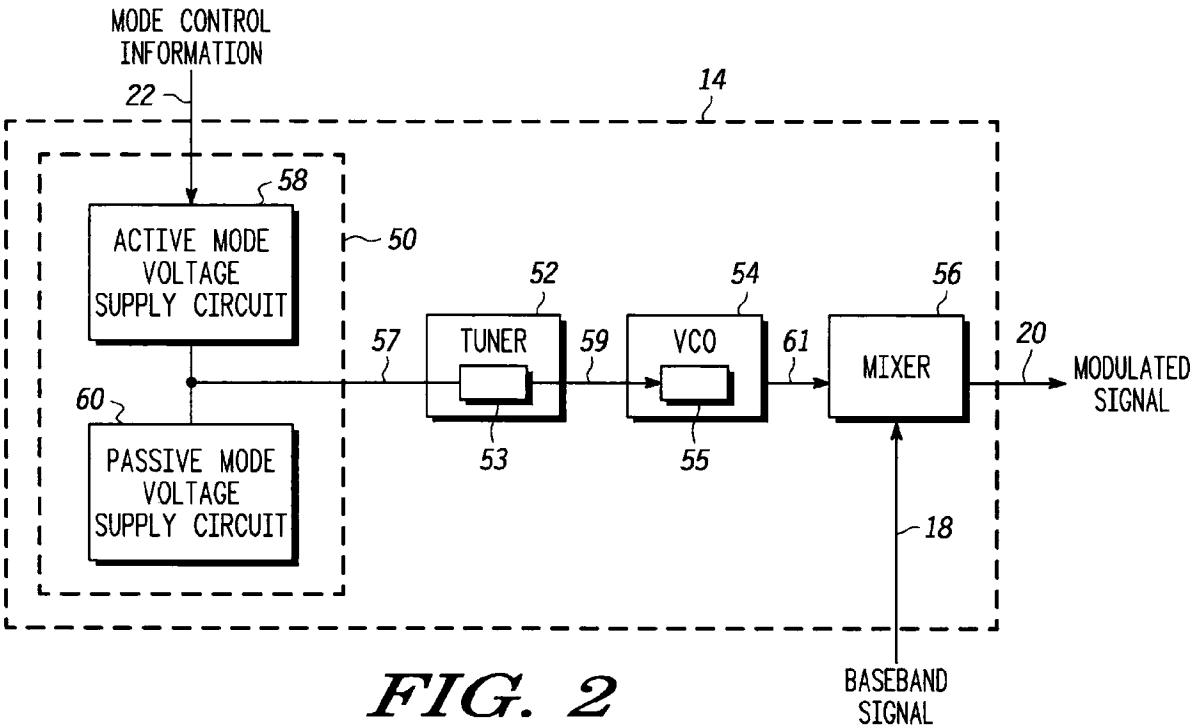
FIG. 2 is a functional block diagram of an exemplary modulation circuit that includes a dual mode voltage supply circuit.

Referring now to FIG. 2, a functional block diagram of the modulation circuit 14 is depicted. The modulation circuit 14, which may be implemented as a single integrated circuit (IC), may include a dual mode voltage supply circuit 50, a tuner 52 that includes a level shifting circuit 53 (as known in the art), a voltage controlled oscillator (VCO) 54 that includes a varactor circuit 55 (as known in the art), and a radio frequency (RF) mixer 56. The varactor circuit 55 is operative to provide a variable capacitance that may be used to control oscillations of the VCO 54. The varactor circuit 55 may include one of more varactors. The dual mode voltage supply circuit 50 is operative to supply power to the level shifting circuit 53, which generates a tuning control signal 59 to control the capacitance of the varactor circuit 55. More specifically, the dual mode voltage supply circuit 50 supplies a set voltage 57 (e.g., 2.3V) and varies current capacity depending on demand requirements of the level shifting circuit 53. The tuner 52 may include a state machine or any other suitable circuit to control the level shifting circuit 53 and thus adjust oscillations of the VCO 54 to a predetermined frequency band or channel in order to tune to different frequencies as known in the art. Although only one VCO 54 is depicted, skilled artisans will recognize that multiple VCOs 54 may be used to collectively oscillate at the predetermined frequency. The RF mixer 56 is operative to receive an output 61 from the VCO 54 and generate the modulated signal 20 based on the baseband signal 18.

The dual mode voltage supply circuit 50 may include an active mode voltage supply circuit 58 operatively coupled to a passive mode voltage supply circuit 60. The active and passive mode supply circuits 58, 60 are operatively coupled to the tuner 52 and selectively supply the set voltage 57 based on mode control information 22. More specifically, when the mode control information 22 indicates that an increased current capacity is required, such as when a user selects a new television channel, the dual mode voltage supply circuit 50 operates in an active mode. When operating in the active mode, the active mode voltage supply circuit 58 is operative to supply the set voltage 57 (e.g., 2.3V) and the passive mode voltage supply circuit 60 is overridden. When supplying the set voltage 57, the active mode voltage supply circuit 58 is operative to provide a first current capacity. When the mode control information 22 does not indicate that an increased current capacity is required, such as when the tuner 52 has locked onto the set channel, the dual mode voltage supply circuit 50 operates in a passive mode. When operating in the passive mode, the passive mode voltage supply circuit 60 is operative to supply the set voltage 57 (e.g., 2.3V) and the active mode voltage supply circuit 58 is inactive. The passive mode voltage supply circuit 60 is operative to provide a second current that is less than the first current.

When the tuner 52 is adjusting oscillations of the VCO 54 to a predetermined frequency, the dual mode voltage supply circuit 50 may operate in the active mode in order to supply the set voltage 57 and to provide an increased current to the tuner 52. In some embodiments, the tuner 52 may be operative to generate the mode control information 22 in response to a change in frequency condition. The change in frequency condition may occur when a user and/or algorithm causes the tuner 52 to adjust the oscillations of the VCO 54 to a different frequency band or channel. When the VCO 54 is oscillating at the predetermined frequency, the dual mode voltage supply circuit 50 may operate in the passive mode in order to supply the set voltage 57 and provide a decreased current to the tuner 52. In some embodiments, the tuner 52 may be operative to generate the mode control information 22 when the VCO 54 is oscillating at the predetermined frequency. By providing the set voltage 57 with a reduced current, noise that is induced with current may be minimized when the VCO 54 is tuned to the predetermined frequency band or channel.

Figure 3:
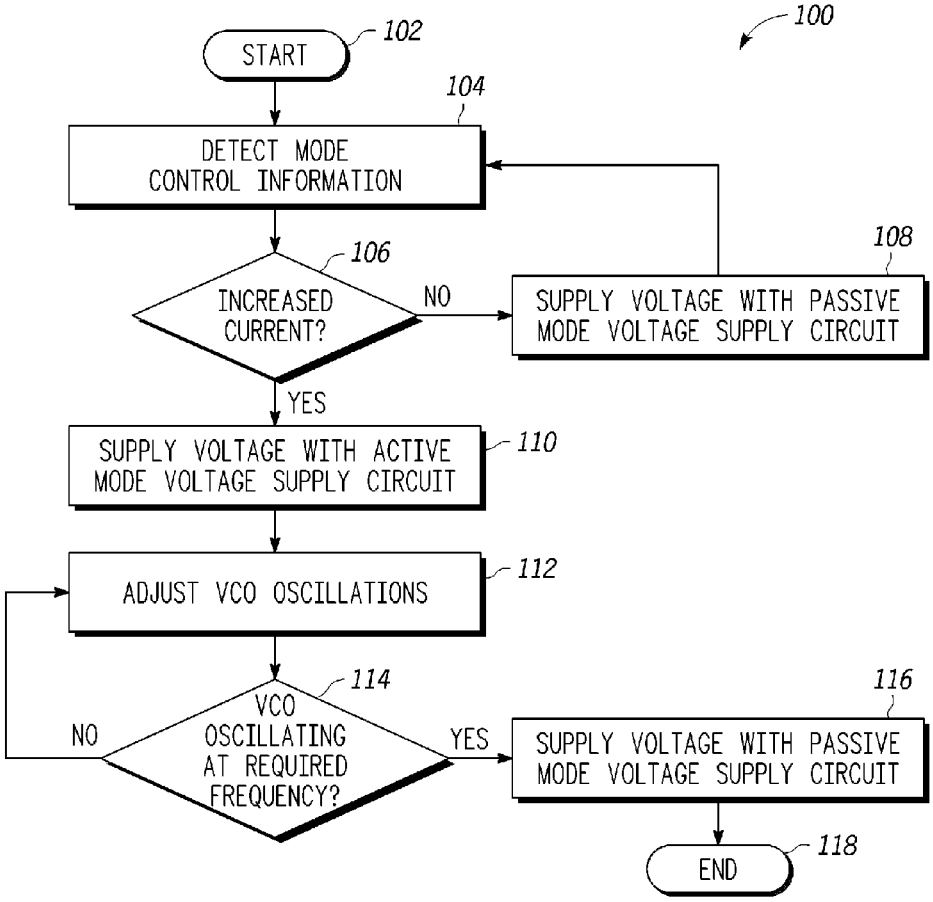
FIG. 3 is a flowchart depicting exemplary steps that may be taken by the modulation circuit.

Referring now to FIG. 3, exemplary steps that may be taken by the modulation circuit 14 or other structure are generally depicted at 100. The process starts in step 102, when the modulation circuit 14 is powered on. In step 104, the modulation circuit receives mode control information 22. The mode information 22 may come from a user input such as when a user selects a new television channel, or the tuner 52. In step 106, the modulation circuit 14 determines whether the tuner 52 requires an increased current capacity. As previously discussed, the tuner 52 requires an increased current capacity when adjusting oscillations of the VCO 54. If the tuner 52 does not require an increased current capacity, the dual mode voltage supply circuit 50 operates in the passive mode and the passive mode voltage supply circuit 60 supplies the set voltage 57 to the tuner 52 in step 108. The process returns to step 104 to monitor the mode control information 22.

If the modulation circuit 14 determines that the tuner 52 requires an increased current capacity in step 106, the dual mode voltage supply circuit 50 operates in the active mode and the active mode voltage supply circuit 58 supplies the set voltage 57 with an increased capacity in step 110. In step 112, the tuner 52 adjusts the oscillations of the VCO 54. In step 114, the tuner 52 determines whether the VCO 54 is oscillating at the predetermined frequency. If the VCO 54 is not operating at the predetermined frequency, the process returns to step 112 and the tuner 52 continues to adjust the oscillations of the VCO 54. However, if the VCO 54 is oscillating at the predetermined frequency, the dual mode voltage supply circuit 50 transitions to the passive mode in step 116. When operating in the passive mode, the passive mode voltage supply circuit 60 supplies the set voltage 57 to the tuner 52 with a decreased current capacity. The process ends in step 118 by repeating if different mode control information 22 is provided, such as a user indicating to change to a different channel, or any other change in the mode control information 22.

Figure 4:
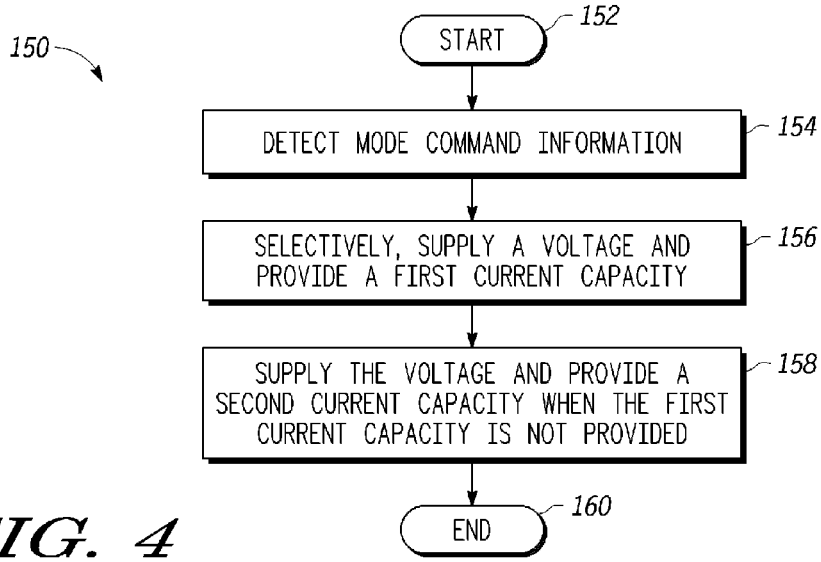
FIG. 4 is a flowchart depicting exemplary steps that may be taken by the dual mode voltage supply circuit.

Referring now to FIG. 4, exemplary steps that may be taken by the dual mode voltage supply circuit 50 are generally depicted at 150. The process starts in step 152 when the dual mode voltage supply circuit 50 is powered on. In step 154, the dual mode voltage supply circuit 50 detects the mode control information 22. In step 156, the dual mode voltage supply circuit 50 selectively supplies the voltage and the first current capacity based on the mode control information 22 via a switching operation. More specifically, the active mode voltage supply circuit 58 detects the mode control information 22 and determines whether the tuner 52 requires an increased current capacity based thereon. If the tuner 52 is adjusting the oscillations of the VCO 54 and hence requires an increased current capacity, the dual mode voltage supply circuit 50 operates in the active mode. As previously discussed, when operating in the active mode, the active mode voltage supply circuit 58 is operative to supply the set voltage 57 and provide the first current capacity.

In step 158, the dual mode voltage supply circuit 50 operates in the passive mode when the first current capacity is not being provided. More specifically, if the tuner 52 is not adjusting the oscillations of the VCO 54 and hence does not require an increased current capacity, the dual mode voltage supply circuit 50 operates in the passive mode. As previously discussed, when operating in the passive mode, the passive mode voltage supply circuit 60 is operative to supply the set voltage 57 and provide the second current capacity. The process ends in step 160 by looping back to 154 and waiting for new mode control information 22.

Figure 5:
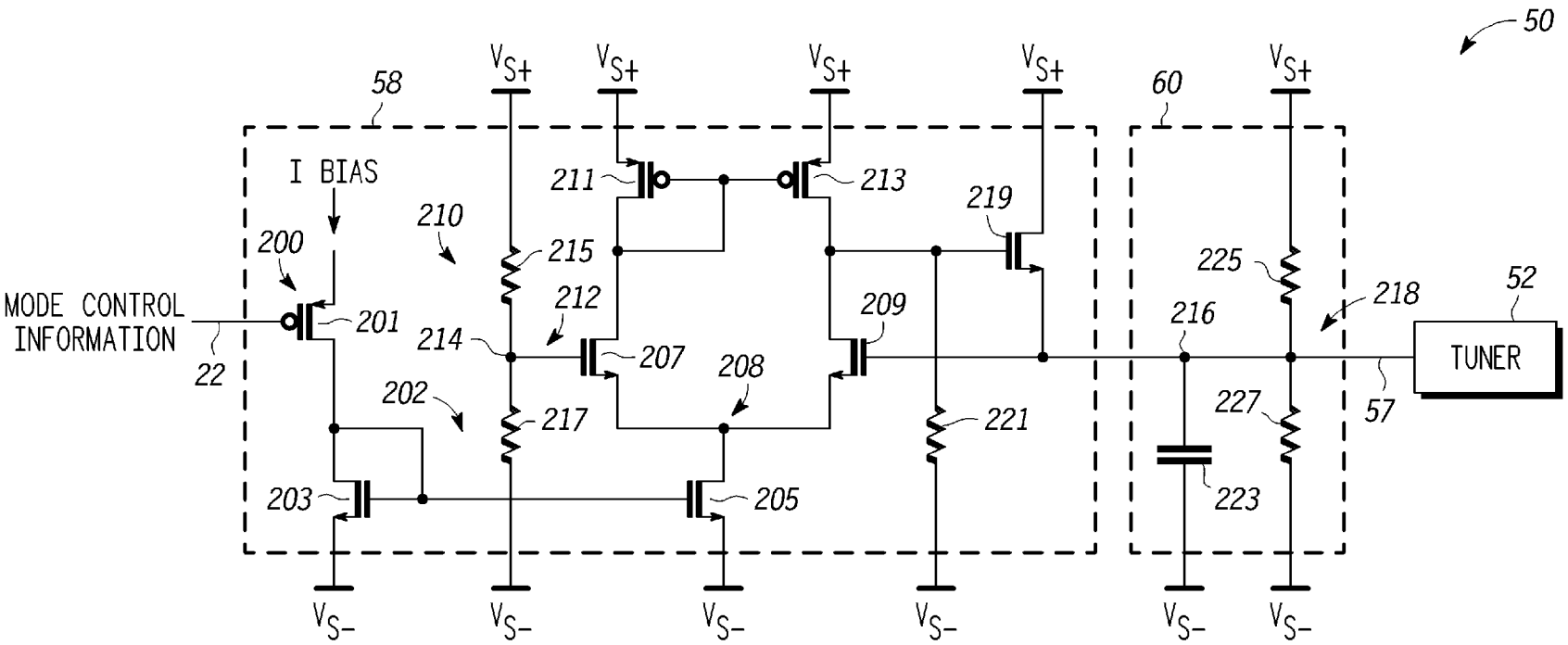
FIG. 5 is a circuit diagram illustrating one example of the dual mode voltage supply circuit.

Referring now to FIG. 5, an exemplary implementation of the dual mode voltage supply circuit 50 is depicted. The active mode voltage supply circuit 58 may include a switch 200 that is operative to enable the active mode voltage supply circuit 58 to supply the voltage to the tuner 52. In this exemplary embodiment, the switch 200 is implemented with a metal oxide semiconductor field effect transistor (MOSFET) 201. However, any suitable device that is operative as a switch may be implemented as the switch 200. The switch 200 has a source terminal operatively coupled to a current source Ibias, a drain terminal operatively coupled to a current mirror 202, and a gate terminal operative to receive the mode control information 22. When the mode control information 22 is greater than a threshold voltage of transistor 201, a short is effectively created between the current source Ibias and the current mirror 202.

The current mirror 202 may comprise transistors 203 and 205. A respective source terminal of transistors 203 and 205 are each operatively coupled to a negative source voltage Vs−. Although depicted as a negative voltage, skilled artisans will appreciate that Vs− may be any voltage that is less than a positive source voltage Vs+ including ground. A respective gate terminal of transistors 203 and 205 are operatively coupled to each other. A drain terminal of transistor 203 is operatively coupled to the gate terminals of transistors 203 and 205. A drain of transistor 205 is operatively coupled to a differential amplifier 208. During operation, transistor 205 acts as a current source when the switch 200 enables operation of the active mode voltage supply circuit 58.

The differential amplifier 208 may comprise transistors 207, 209, 211, and 213. More specifically, respective source terminals of transistors 207 and 209 are operatively coupled to each other. Respective drain terminals of transistors 207 and 211 are operatively coupled to each other. Respective drain terminals of transistors 209 and 213 are operatively coupled to each other. Respective source terminals of transistors 211 and 213 are operatively coupled the positive source Vs+. Although depicted as a positive voltage, skilled artisans will appreciate that Vs+ may be any voltage that is greater than Vs− including ground. Respective gate terminals of transistors 211 and 213 are operatively coupled to drain terminals of transistors 207 and 211. Respective gate terminals of transistors 207 and 209 are operative as differential inputs to the differential amplifier 208.

The active mode voltage supply circuit 58 may also include a voltage divider circuit 210, the voltage divider circuit 210 may comprise two resistors 215 and 217 operatively coupled in series between source voltages Vs+ and Vs−. Although resistors 215 and 217 are depicted as single resistors, skilled artisans will appreciate that one or more resistors may be implemented in place of resistors 215 and/or 217. A first input 212 of the differential amplifier 208 is operatively coupled to the voltage divider circuit 210 at node 214.

The active mode voltage supply circuit 58 may also include transistor 219. A gate terminal of transistor 219 may be operatively connected to the drain terminals of transistors 209 and 213. A resistor 221 is operatively coupled between the gate terminal of transistor 219 and Vs−. As with resistors 215 and 217, resistor 221 may be implemented as one or more resistors. A source terminal of transistor 219 may be operatively coupled to a second input of the differential amplifier 208. More specifically, the source terminal of transistor 219 may be operatively coupled to the gate terminal of transistor 209 at node 216. When the dual mode voltage supply circuit 50 is operating in the active mode, node 216 is operative as an output of the active mode voltage supply circuit 58. Therefore, node 216 is operatively coupled to the tuner 52 in order to supply the voltage and provide the first current capacity.

The passive mode voltage supply circuit 60 may include a second voltage divider and a capacitor 223. The second voltage divider 218 may include resistors 225 and 227 operatively coupled in series between Vs+ and Vs−. Resistors 225 and 227 may be implemented as one or more resistors. Capacitor 223, which may be implemented as one or more capacitors, may be operatively between the second voltage divider 218 at node 216 and Vs−. Node 216 also serves as an output of the passive mode voltage supply circuit 60 and is therefore operatively coupled to the tuner 52 to supply the voltage and provide the second current capacity.

In some embodiments, resistor values 215, 217, 227, and 225 should be chosen so that node 214 and 216 are operative to provide approximately the same voltage level. For example, in order to supply a voltage of 2.3V to the tuner 52, resistors 215 and 225 should each have a resistance of approximately 10 k Ohms and resistors 217 and 227 should each have a resistance of approximately 23 k Ohms when Vs+ is at 3.3V and Vs− is at ground.

Figure 6:
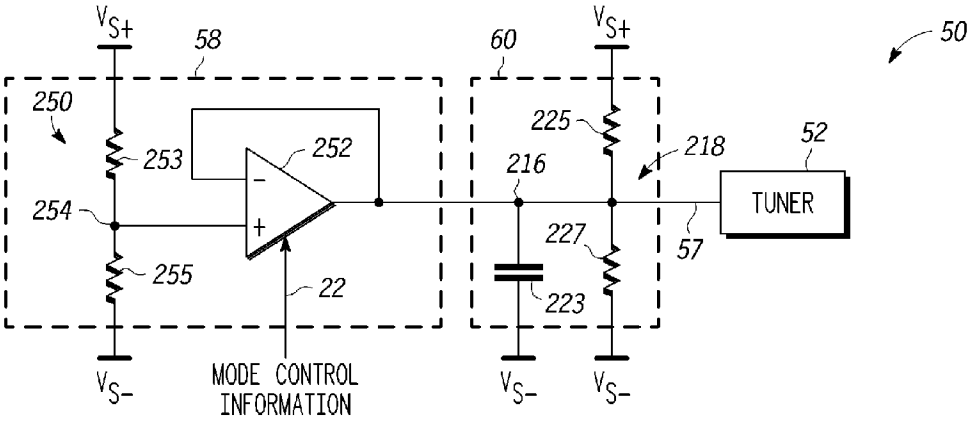
FIG. 6 is an alternative circuit diagram of the dual mode voltage supply circuit.

Referring now to FIG. 6, a second exemplary implementation of the dual mode voltage supply circuit 50 is depicted. The passive mode voltage supply circuit 60 is identical to the embodiment depicted in FIG. 5. However, the active mode voltage supply circuit 58 is depicted as including a voltage divider circuit 250 and an operational amplifier 252. The voltage divider circuit 250 may comprise two resistors 253 and 255 operatively coupled in series between source voltages Vs+ and Vs−. Resistors 253 and 255 may comprise one or more resistors. Resistor 253 should have a resistance value approximately equivalent to the resistance of resistor 225 and resistor 255 should have a resistance approximately equivalent to the resistance of resistor 227.

The operational amplifier 252 may have a first input operatively coupled to the voltage divider circuit 250 at node 254. A second input of the operational amplifier 252 may be operatively coupled to an output of the operational amplifier 252 at node 216 providing feedback and thus creating a unity gain amplifier. Node 216 operates as the output of the active mode voltage supply circuit 58 and is therefore operatively coupled to the tuner 52. The operational amplifier 252 may be enabled based on mode control information 22.

Figure 7:
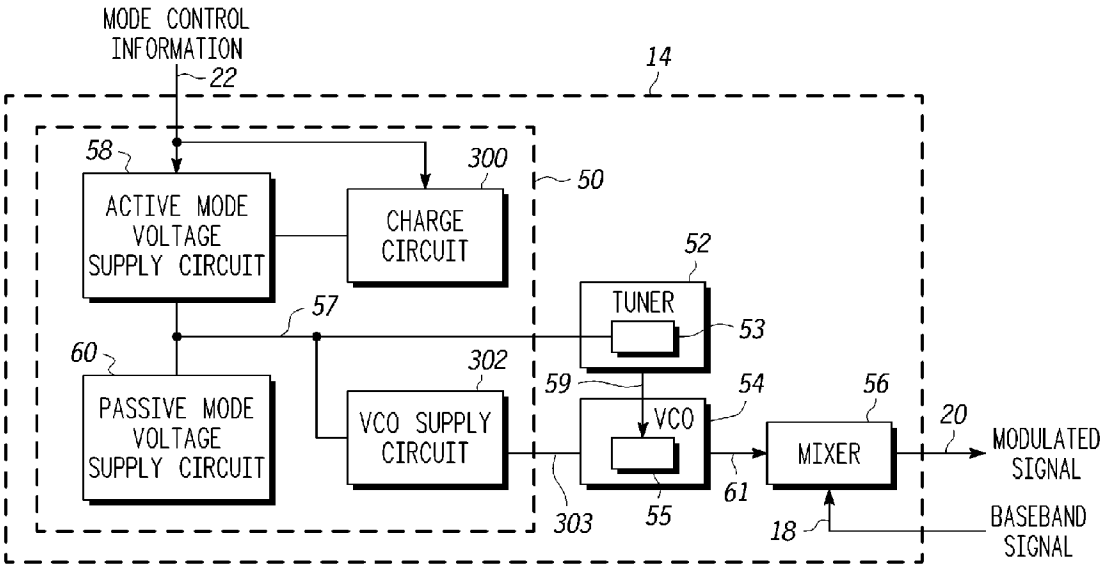
FIG. 7 is a functional block diagram of the modulation circuit including a charge circuit and a voltage supply circuit.

Referring now to FIG. 7, a functional block diagram of a second embodiment of the modulation circuit 14 is depicted. As with the embodiment of FIG. 2, the modulation circuit 14, which may be implemented as a single integrated circuit (IC), may include the dual mode voltage supply circuit 50, the tuner 52 that includes the level shifting circuit 53, the VCO 54 that includes the varactor circuit 55, and the RF mixer 56. In addition to the embodiment of FIG. 2, the dual mode voltage supply circuit 50 may also include a charge circuit 300 and a VCO voltage supply circuit 302. The charge circuit 300 may be operatively coupled to the active mode voltage supply circuit 58. The charge circuit 300 is selectively operative to charge on chip capacitor 223 of the passive mode voltage supply circuit 60. More specifically, when the mode control information 22 indicates that the dual mode voltage supply circuit 50 should operate in the passive mode, the charge circuit 300 acts to quick charge on chip capacitor 223. Quick charging capacitor 223 allows the voltage supplied to the tuner 52 to quickly rise to the set voltage 57 and thus minimizes the delay in which the set voltage 57 can be supplied.

The VCO voltage supply circuit 302 may be operatively coupled to the output of the active and passive mode voltage supply circuits 58, 60 and the VCO 54. The VCO voltage supply circuit 302 is operative to supply a VCO voltage 303 to power the VCO 54. The VCO voltage 303 is supplied independent of the mode control information 22. In some embodiments, the VCO voltage 303 is continually supplied to the VCO 54 during operation of the modulation circuit 14.

Figure 8:
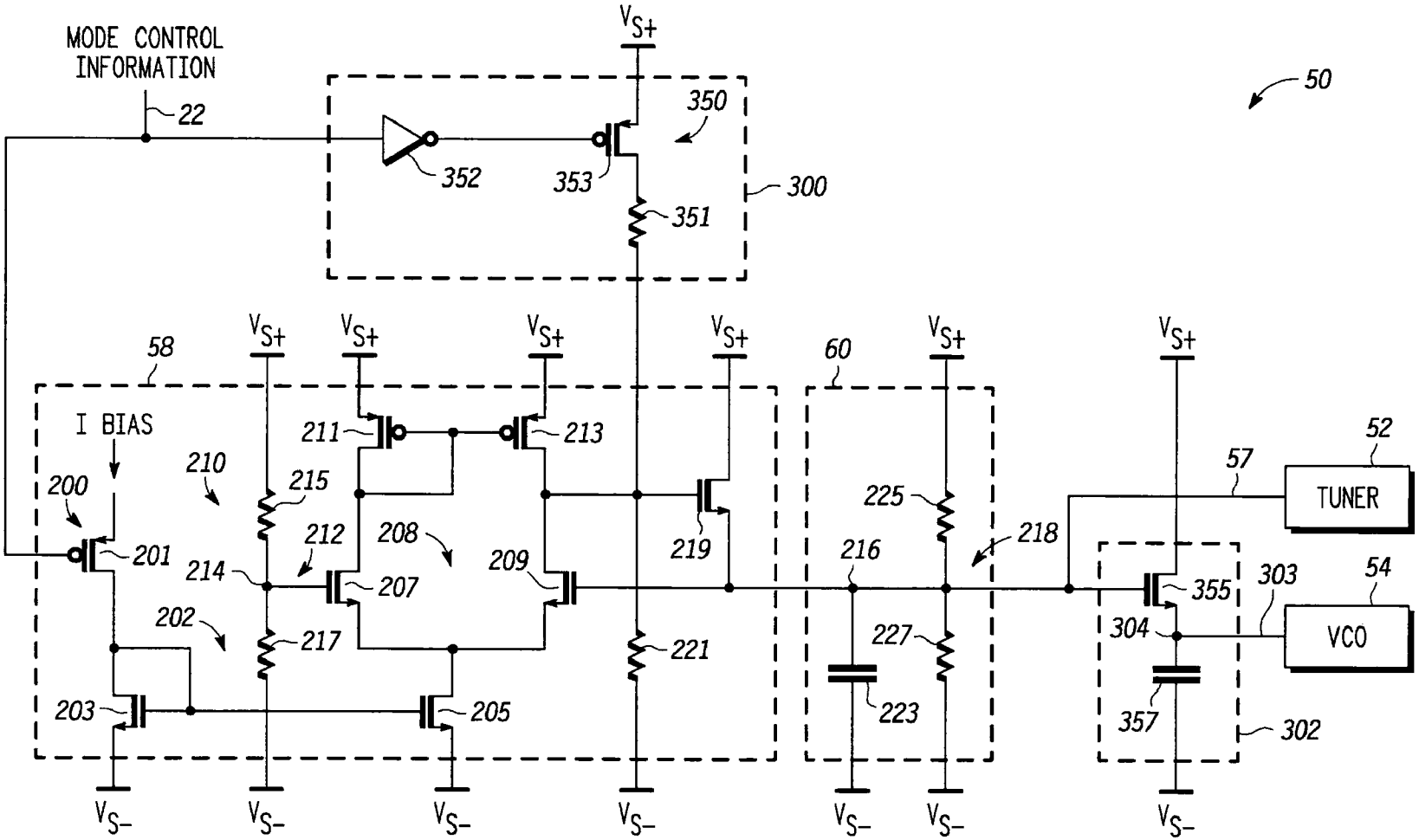
FIG. 8 is a circuit diagram illustrating one example of the functional block diagram of FIG. 7.

Referring now to FIG. 8, an exemplary implementation of the dual mode voltage supply circuit 50 including the charge circuit 300 and VCO voltage supply circuit 302 is depicted. The active and passive mode voltage supply circuits 58, 60 are implemented in the same manner as depicted in FIG. 5. The charge circuit 300 may include a second switch 350 and resistor 351. Although depicted as a single resistor, skilled artisans will appreciate that resistor 351 may be implemented as one or more resistors. The switch 350 may be implemented as a transistor 353. A source terminal of transistor 353 may be operatively coupled to Vs+. Resistor 351 may be operatively coupled between a drain terminal of transistor 353 and the gate terminal of transistor 219. A gate terminal of transistor 353 may be operatively coupled to the mode control information 22. In this example, since both transistors 201 and 353 are p-channel MOSFETs, an inverter 352 may be operatively coupled between the mode control information 22 and the gate of transistor 353. The inverter 352 ensures that switches 200 and 350 operate in a complementary manner. For example, when switch 200 is closed the inverter 352 ensures that the second switch 350 is open and vice versa. However, if switches 200 and 350 were implemented with complementary MOSFETs (i.e., one as an n-channel MOSFET and the other as a p-channel MOSFET), the inverter 352 may not be necessary and other variation may be used as known in the art.

The VCO voltage supply circuit 302 may include a transistor 355 and a capacitor 357. Capacitor 357 may be implemented as one or more capacitors. A drain terminal of transistor 355 may be operatively coupled to Vs+. A gate terminal of transistor 355 may be operatively coupled to node 216, which is the output of both the active and passive voltage supply circuits 58, 60. Capacitor 357 may be operatively coupled between Vs− and a source of transistor 355 at node 304. Node 304 is operative as an output of the VCO voltage supply circuit 302 and to supply the VCO voltage 303 (e.g., 1.8V) to the VCO 54. In this example, the VCO voltage 303 is less than the set voltage 57 supplied to the tuner 52.

As such, as disclosed herein a dual mode voltage supply that operates in an active and passive mode is selectively switched to provide an increased current capacity to a tuner when required. The dual mode voltage supply circuit is also capable of minimizing noise interference by employing a passive current capacity when the tuner does not require increased capacity. In addition, in some embodiments the dual mode voltage supply circuit does not require any external elements and therefore may be implemented in a signal integrated circuit or included in an integrated circuit with additional modulation components. Implementing the dual mode voltage supply circuit in a single integrated circuit minimizes size and hence costs. The dual mode voltage supply circuit is also capable of switching between active and passive modes within approximately 2 μs providing a voltage variation of less than approximately 1%. Other advantages will be recognized by those of ordinary skill in the art. It will be recognized that any suitable apparatus may include the dual mode voltage supply circuit including, but not limited to, wireless handheld devices, DVD players, media players, units with FM/AM radios, or any other suitable apparatus.

While the preferred embodiments of the invention have been illustrated and described, it is to be understood that the invention is not so limited. Numerous modifications, changes, variations, substitutions and equivalents will occur to those skilled in the art without departing from the spirit and scope of the present invention as defined by the appended claims.

What is claimed is:

1. A dual mode voltage supply circuit comprising:

an active mode voltage supply circuit that is selectively operative to supply a voltage to a tuner based on mode control information, wherein the active mode voltage supply circuit is operative to provide a first current capacity;

a passive mode voltage supply circuit operatively coupled to the active mode voltage supply circuit and that is operative to supply the voltage when the active mode voltage supply circuit is not supplying the voltage, wherein the passive mode voltage supply circuit is operative to provide a second current capacity that is less than the first current capacity and wherein the passive mode voltage supply circuit comprises a voltage divider operatively coupled to at least one capacitor; and a charge circuit operative to charge the at least one capacitor when the passive mode voltage supply circuit is supplying the voltage.

2. The dual mode voltage supply circuit of claim 1 wherein the charge circuit comprises a switch operatively coupled to at least one resistive element, wherein the switch is operatively responsive to the mode control information.

3. An integrated circuit (IC) comprising:

a voltage controlled oscillator (VCO);

a tuner that communicates with the VCO and that is operable to adjust oscillations of the VCO to a determined frequency; and a dual mode voltage supply circuit that comprises:

an active mode voltage supply circuit that is selectively operative to supply a voltage to the tuner based on mode control information, wherein the active mode voltage supply circuit is operative to provide a first current capacity, and a passive mode voltage supply circuit operatively coupled to the active mode voltage supply circuit and that is operative to supply the voltage when the active mode voltage supply circuit is not supplying the voltage, wherein the passive mode voltage supply circuit is operative to provide a second current capacity that is less than the first current capacity.

4. The integrated circuit of claim 3 wherein the active mode voltage supply circuit comprises a switch operative to enable the active mode voltage supply circuit to supply the voltage in response to the mode control information.

5. The integrated circuit of claim 3 wherein the active mode voltage supply circuit comprises a voltage divider circuit operatively coupled to an amplifier circuit that provides the first current capacity.

6. The integrated circuit of claim 3 wherein the passive mode voltage supply circuit comprises a voltage divider operatively coupled to at least one on chip capacitive element.

7. The integrated circuit of claim 6 further comprising a charge circuit operative to charge the at least one capacitive element when the passive mode voltage supply circuit is supplying the voltage.

8. The integrated circuit of claim 7 wherein the charge circuit comprises a switch operatively coupled to at least one resistive element, wherein the switch is operatively responsive to the mode control information.

9. The integrated circuit of claim 6 further comprising a voltage supply circuit operatively coupled to the active and passive mode voltage supply circuits that is operative to provide a second voltage to the VCO independent of the mode control information.

10. The integrated circuit of claim 3 wherein the active mode voltage supply circuit supplies the voltage when the tuner is adjusting the oscillations in response to a change in frequency condition.

11. The integrated circuit of claim 3 wherein the passive mode voltage supply circuit supplies the voltage when the VCO is oscillating at the predetermined frequency.

12. An apparatus comprising:

an input circuit that is operative to generate a baseband signal;

a modulation circuit that comprises:

a voltage controlled oscillator (VCO), a tuner that communicates with the VCO and that is operative to adjust oscillations of the VCO to a predetermined frequency, and a dual mode voltage supply circuit that comprises:

an active mode voltage supply circuit that is selectively operative to supply a voltage to the tuner based on mode control information, wherein the active mode voltage supply circuit is operative to provide a first current capacity, and a passive mode voltage supply circuit operatively coupled to the active mode voltage supply circuit and that is operative to supply the voltage when the active mode voltage supply circuit is not supplying the voltage, wherein the passive mode voltage supply circuit is operative to provide a second current capacity that is less than the first current capacity, wherein the modulation circuit is operative to receive the baseband signal and generate a modulated signal based thereon.

13. The apparatus of claim 12 comprising an output device that is operative to receive the modulated signal and that is operative to generate at least one from the group of: a video and audio output based thereon.

14. The apparatus of claim 12 further comprising a voltage supply circuit operatively coupled to the passive mode voltage supply circuit that is operative to provide a second voltage to the VCO independent of the mode control information.

15. The apparatus of claim 12 wherein the active mode voltage supply circuit supplies the voltage when the tuner is adjusting the oscillations.

* * * * *